US009922632B1

(12) United States Patent
Craig

(10) Patent No.: US 9,922,632 B1
(45) Date of Patent: Mar. 20, 2018

(54) FLEX ACTION TREMOLO SYSTEM AND METAL HOUSING STRING INSTRUMENT

(71) Applicant: Andrew Lee Craig, Watervliet, MI (US)

(72) Inventor: Andrew Lee Craig, Watervliet, MI (US)

( * ) Notice: Subject to any disclaimer, the term of this patent is extended or adjusted under 35 U.S.C. 154(b) by 0 days.

(21) Appl. No.: 15/691,280

(22) Filed: Aug. 30, 2017

Related U.S. Application Data

(60) Provisional application No. 62/385,024, filed on Sep. 8, 2016.

(51) Int. Cl.

| | |
|---|---|
| ***G10H 1/02*** | (2006.01) |
| ***G10H 3/18*** | (2006.01) |
| ***G10D 3/06*** | (2006.01) |
| ***G10D 3/04*** | (2006.01) |

(52) U.S. Cl.
CPC ..... *G10H 3/183* (2013.01); *G10D 3/04* (2013.01); *G10D 3/06* (2013.01); *G10H 3/18* (2013.01)

(58) Field of Classification Search
CPC G10H 3/183; G10H 3/18; G10D 3/04; G10D 3/06
USPC ..... 84/743, 739, 293, 313
See application file for complete search history.

(56) References Cited

U.S. PATENT DOCUMENTS

| | | | | |
|---|---|---|---|---|
| 1,755,019 | A | 4/1930 | Parker, Jr. | |
| 3,185,011 | A | 5/1965 | Anderson | |
| 3,512,443 | A | 5/1970 | Parson et al. | |
| 3,686,993 | A | 8/1972 | Fender | |
| 4,295,403 | A * | 10/1981 | Harris | G10D 3/06 84/269 |
| 4,930,389 | A * | 6/1990 | Kunstadt | G10D 3/06 84/293 |
| 6,194,645 | B1 * | 2/2001 | Rose | G10H 1/44 84/313 |
| 6,265,648 | B1 * | 7/2001 | Steinberger | G10D 1/00 84/267 |
| 6,657,112 | B1 | 12/2003 | Zigounakis | |
| 6,831,218 | B2 | 12/2004 | Steinberger | |
| 7,259,309 | B1 | 8/2007 | Lovelace et al. | |
| 8,558,096 | B2 | 10/2013 | Altheim | |
| 9,368,092 | B2 | 6/2016 | Hooker | |
| 2007/0107579 | A1 | 5/2007 | Babicz | |
| 2007/0289427 | A1 * | 12/2007 | Liang | G10D 1/08 84/291 |
| 2014/0013923 | A1 | 1/2014 | Mehrgan | |

FOREIGN PATENT DOCUMENTS

| | | | |
|---|---|---|---|
| CA | 2811930 | A1 | 3/2011 |

* cited by examiner

*Primary Examiner* — Jeffrey Donels
(74) *Attorney, Agent, or Firm* — Gregory L. Ozga; Warn Partners, P.C.

(57) ABSTRACT

A stringed instrument having a flex action tremolo. The assembly includes a neck of the stringed instrument that is capable of pivoting to cause the stings of the instrument to slack or tighten depending on the movement of the neck. A metal bar extends across a portion of the hollow portion of the body and is connected to the neck. There is at least one spring-loaded connection between the metal bar and the inside surface of the hollow portion of the body. This allows the metal bar and neck to pivot at one or more angles relative to the longitudinal axis of the neck, while maintaining the tuning of the guitar when the neck is returned to a neutral position.

20 Claims, 9 Drawing Sheets

FLEX ACTION TREMOLO SYSTEM AND METAL HOUSING STRING INSTRUMENT

FIELD OF THE INVENTION

The present invention is directed to a flex action tremolo system for a stringed instrument.

BACKGROUND OF THE INVENTION

In the field of musical instruments a tremolo is defined in the Oxford dictionary as "a wavering effect in a musical tone, typically produced by rapid reiteration of a note, or sometimes by rapid repeated variation in the pitch of a note or by sounding two notes of slightly different pitches to produce prominent overtones. Compare with vibrato." Guitars, in particular electric guitars use a tremolo arm or bar which is defined in the Oxford dictionary as "[a] lever on an electric guitar producing a tremolo," while other known definitions include "[a] mechanism in an organ producing a tremolo."

Tremolo (also called a "whammy") bar can be found on certain types of guitars (e.g., electric guitars) and are generally used, at least in part, to change the pitch of sounds produced by such guitars. Typically, tremolo bars are attached to a bridge section of a guitar (comprising a bridge assembly that anchors strings to the body of the guitar) and are capable of pivoting in a clockwise or counter-clockwise direction with respect to the body of the guitar and capable of being pushed towards the body of the guitar using a grip known as a whammy or tremelo bar. In one application, the pitch of sounds produced by the guitar can be changed by applying a force to the tremolo bar in a direction away from the body of the guitar (e.g., for Stratocaster® style guitars having a "floating bridge" arrangement). In another application, the pitch can be changed by applying a force to the tremolo bar in a direction towards the body of the guitar (e.g., for Stratocaster® and Bigsby® style guitars). Conventionally, in order to access and use the tremolo bar, a user may need to switch positions of his or her hands from the strings of the guitar to the tremolo bar, which can result in undesirable interrupted play.

It is desirable to provide an assembly (or improved tremolo bar) that is capable of taking advantage of the position of a user's body (hand, wrist, or otherwise) with respect a guitar such that the user does not need to switch positions of his or her hands from the strings of the guitar to the assembly, thereby providing an improvement over the whammy bar found on many electric guitars.

Also tremolo bars are typically found on guitars but are not always on other instruments, especially larger instruments such as bass instruments, pianos or instruments requiring more difficult hand positioning such as violins, fiddles, lap steels, harpsicords or autoharps.

In another aspect stringed instruments having a neck for providing frets such as guitars, violins, fiddles, cellos, basses, banjos allow for different notes to be played when a musician presses a string against a desired fret causing a different sound or note to be emitted from the string when it is played. One problem that can occur is that the amount of pressure that has to be applied to a string to hold it against the fret can be quite high and difficult for some users having physical limitations such as poor muscle strength in their hands, arthritis, smaller or missing fingers etc. It is therefore desirable to provide a stringed instrument where the neck is adjustable to position the strings closer to the frets on the neck depending on the musician's physical requirements or playing style.

In a final aspect stringed instruments such as guitars, violins, fiddles, cellos, basses, banjos, pianos, harps harpsicords or autoharps and the like typically have a hollow body that is made of wood or similar fibrous material that serves as a sound amplifier. Harder housing materials such as metal are not used because they are too difficult to achieve the desired tuning or amplification to be used. The present invention provides a metal housing for a stringed instrument that includes an independent adjustment that achieves desirable tuning and amplification.

SUMMARY OF THE INVENTION

The present invention is directed to an assembly for attachment to a stringed instrument. The stringed instrument has a body with a hollow portion having an inside surface of the body. A neck portion of the stringed instrument has a first end extending through the body and partially into the hollow portion of the body. A second end of the neck extends away from the body. The neck has a longitudinal axis that extends between the first end and the second end. There is at least one flexible connection between the neck and the body that allows the neck to pivot at one or more angles relative to the longitudinal axis of the neck. A plurality of strings extend along the longitudinal axis of the neck and are disposed above and outside surface of the body and the neck. A bridge is coupled to the body at the outside surface and a first end of the plurality of strings are connected or coupled to the bridge. A second end of the plurality of strings are connected to nuts near the second end of the neck.

The assembly further includes a metal bar extending across a portion of the hollow portion of the body and is connected to the inside surface of the hollow portion of the body. The metal bar has a first end that is connected to the first end of the neck and a second end that extends in parallel along the longitudinal axis of the neck, through the hollow portion of the body. There is also at least one spring-loaded connection between the metal bar and the inside surface of the hollow portion and has at least one post connected to the inside surface of the hollow portion. The metal bar with at least one compression spring is connected about the post and extends between the metal bar and the inside surface of the hollow portion of the body, such that the metal bar rests on the at least one spring-loaded connection and moves along the longitudinal length of the post, thereby allowing the metal bar to pivot at one or more angles relative to the longitudinal axis of the neck.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
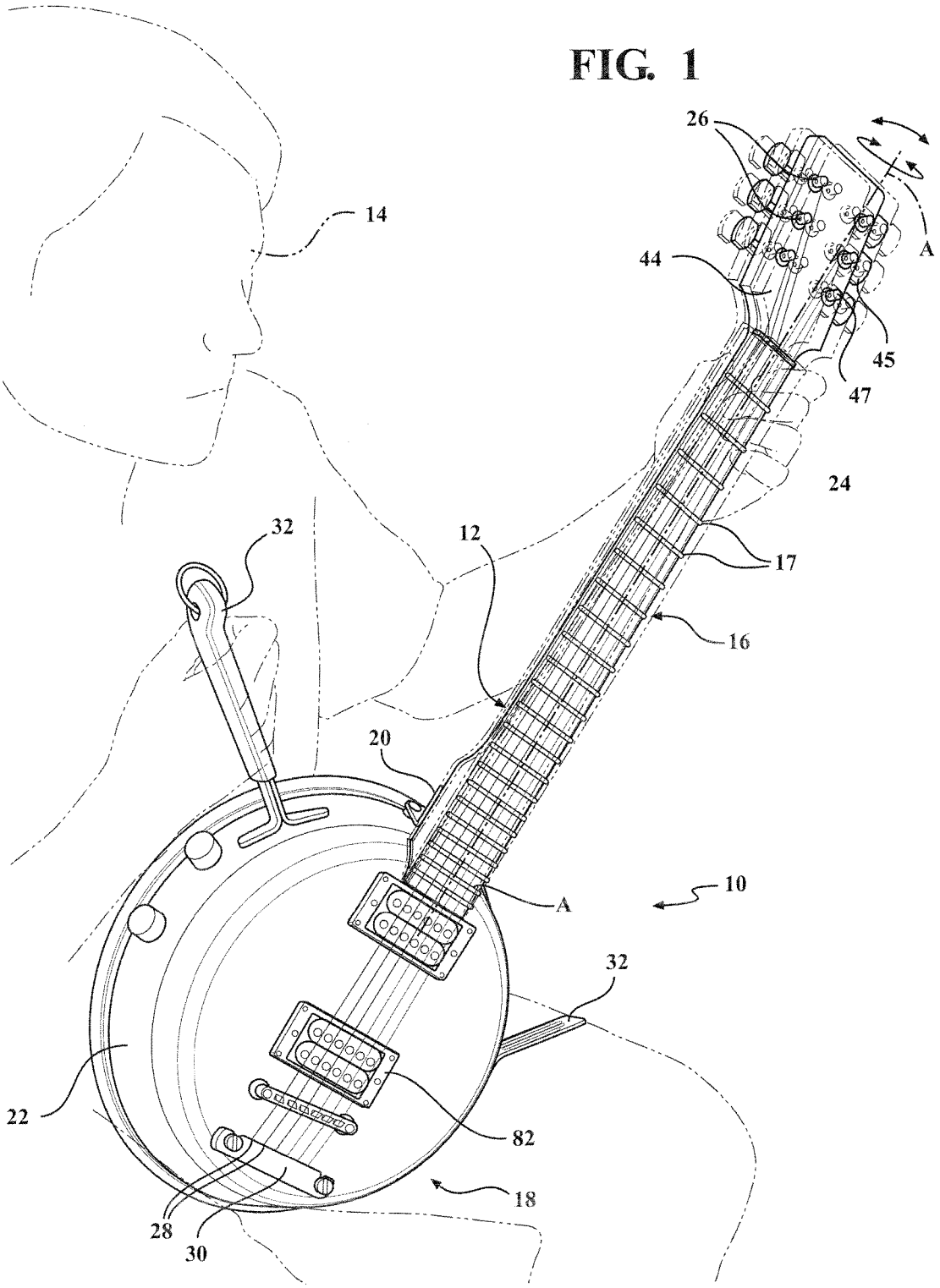
FIG. 1 is a front perspective view of a stringed instrument being played in accordance with one embodiment of the invention.
Figure 2:
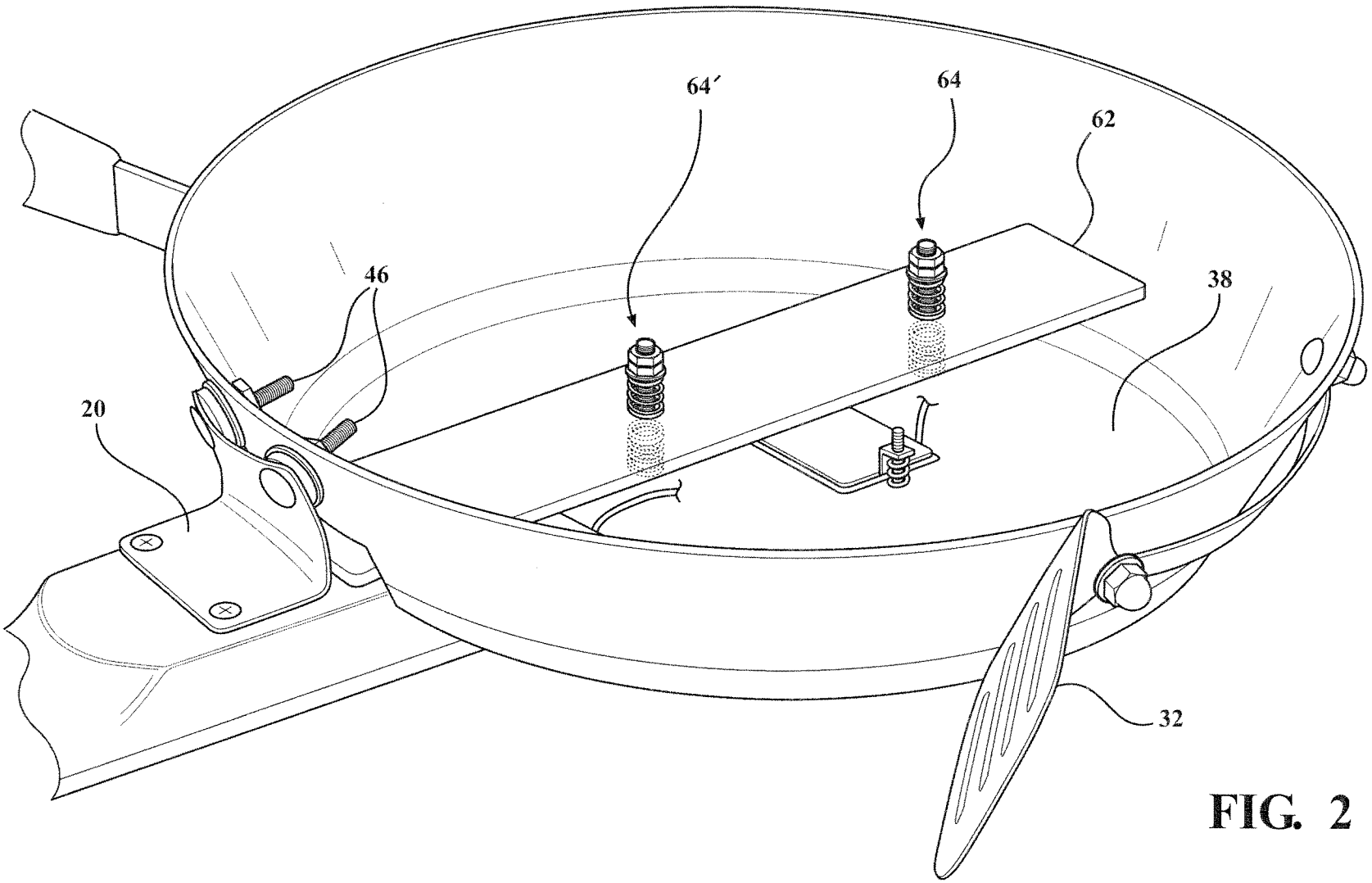
FIG. 2 is a rear perspective view of a portion of the stringed instrument having the rear housing removed.
Figure 3:
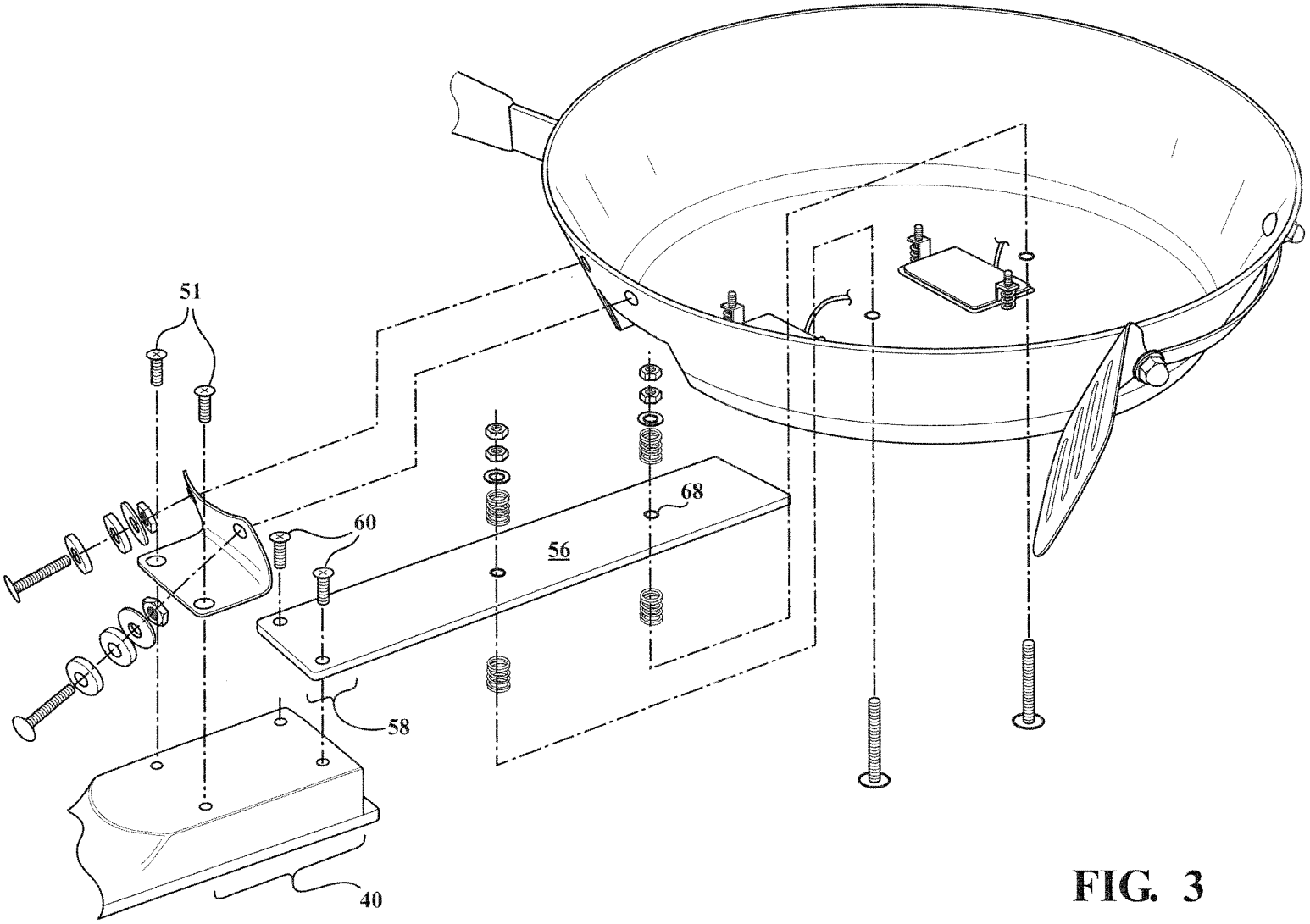
FIG. 3 is an exploded rear perspective view of a portion of the stringed instrument having the rear housing removed.
Figure 4:
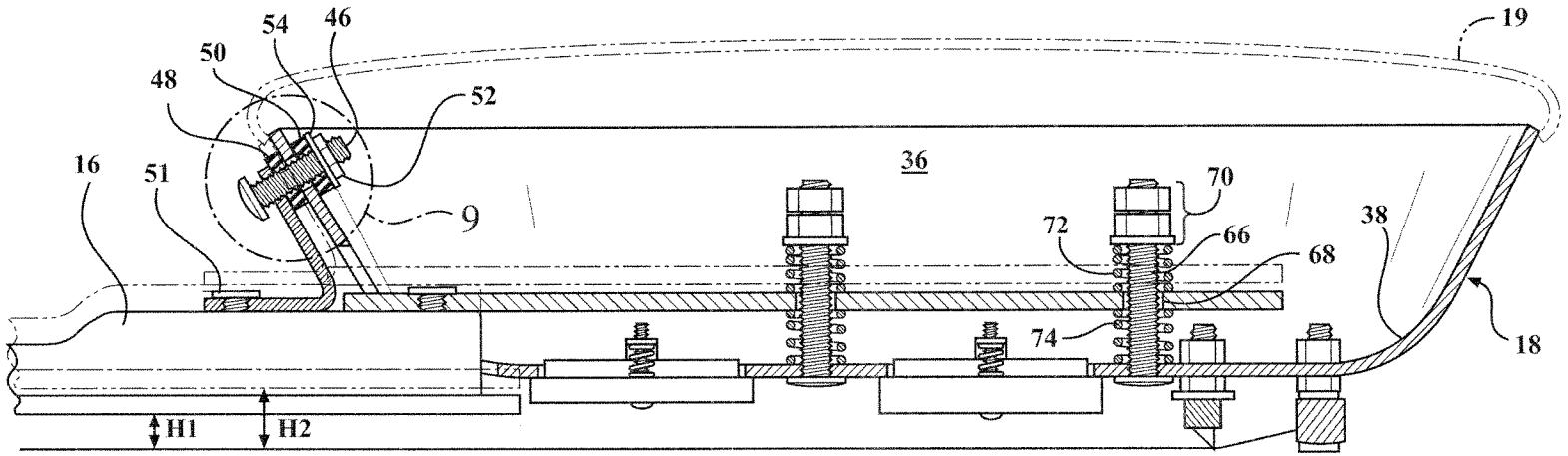
FIG. 4 is a cross-sectional side plan view of a portion of the stringed instrument.

The present invention relates to a stringed instrument 10 have a flex action tremolo 12. Referring to FIG. 1 the stringed instrument 10 is being played by a user 14 and includes a body 18, a neck 16 with a plurality of frets 17 used for the purpose of playing different notes and chords on the instrument in combination with a plurality of strings 22.

The tremelo 12 of the stringed instrument 10 is actuated by moving the neck 16 in a direction about a longitudinal axis A-A of the neck 16. The neck 16 is moveable in a direction that is three hundred sixty degrees and is held in place to the body 18, in part by a flexible connection bracket 20 that connects between the neck 16 and an outside surface 22 of the body 18. When the neck 16 is moved the plurality of strings 22 become stretched or slacked.

The plurality of strings 22 are connected to the neck 16 at a first end 24 and at a second end 28 to a bridge 30 connected to the outside surface 22 of the body 18. On the outside surface 22 of the body 18 is a top grip 32 and bottom leg grip 34 that are generally positioned at opposing sides of the body 18. The top grip 32 allows the user 14 to grab the top grip 32 with one hand and push or pull the neck 16 with the other hand in order actuate the tremolo 12. Additionally the bottom leg grip 34 is used by the user 14 to rest on the leg of the user 14 or on some other surface so to provide another point of support so that the neck 16 can be moved to actuate the tremolo 12. The use of the top grip 32 and the bottom leg grip 34 is not always necessary since the user 14 can also actuate the tremolo 12 by grasping or hugging the body 18 with the arms of the user, while moving the neck 16. The top grip 32 and the bottom let grip 34 provide additional holding points when faster or additional stretching or slacking of the plurality of strings 24 is desired to achieve a specific type of sound.

Referring now to FIGS. 2-5 additional components of the tremolo 12 are shown. The body 18 serves the purpose of providing amplification and provides different types of desired sound properties and includes a rear cover 19. In conventional stringed instruments the body 18 is made of wood, polymer, animal skin, synthetic skin material to provide different sounds. In the past thick metal is not used. In one embodiment of the present invention the housing 18 is made of metal which include, but are not limited to iron, steel, copper, aluminum, titanium, brass, alloys, etc. It is also contemplated that the body 18 is made of polymeric material or wood.

The body 18 has a hollow portion 36 with an inside surface 38 of the hollow potion 18. The neck 16 has a region 40 near the first end extending through an aperture 42 of the body 18 into the hollow portion 36 of the body 18 and a second end region 44 extending away from the body 18 to a location outside of the hollow portion 36 of the body 18. Referring also to FIG. 1, the second end region 44 is sometimes referred to as the headstock and contains several adjustable tuning pegs 45 that are each adjustably connected to a nut 47 that connects to the first end 24 of one of the plurality of strings 22. The tuning pegs 45 are turned and cause the nut to rotate 47 and adjust the tension of the plurality of strings 22 in a manner similar to conventional guitars or other stringed instruments. The neck 16 neck has the longitudinal axis A-A extending between the first end and the second end region 44.

Near the aperture 42 of the body 18 there the flexible connection bracket 20 that pivotally connects the neck 16 to the body 18. As shown in the figures the flexible connection bracket 20 is connected to the outside surface 22 of the body 18, however it is within the scope of this invention for the connection bracket 20 to be connected between the inside surface 38 of the hollow portion 36 and a portion of the neck 16 extending into the hollow portion 36. The flexible connection bracket 20 is connected to the body 18 using two fasteners 46, where the fasteners pass through an aperture 19 in the body that is large enough to allow the fasteners 46 to move within the aperture 19 and pivot as the neck 16 is moved. Between the flexible connection bracket 20 and the outside surface 22 of the body 18 there is an outside rubber cushion 48 connected about each of the two fasteners 46. In the hollow portion 36 of the body 18 where each of the two fasteners 46 are connected using a nut 52 with a retainer 54. Between each retainer 54 and the inside surface 38 there is an inside rubber cushion 50. The bracket The outside rubber cushion 48 and inside rubber cushion 50 allows the flexible connection bracket 22 pivot thereby allowing the neck 16 to pivot 360° at one or more angles relative to the longitudinal axis A-A of the neck 16. While the inside rubber cushion 50 and outside rubber cushion 48 are shown as being round or separate pieces connected about each of the fasteners 46, it is within the scope of this invention for the rubber cushions to be solid blocks of rubber or some other type of elastic material that will allow the flexible connection bracket 22 to pivot at one or more angles relative to the axis A-A of the neck 16. The flexible connection bracket 22 connects to the region 40 near the first end of the neck 16 using fasteners.

The tremolo 12 also includes a metal bar 56 that is formed of rigid metallic material such as any of the materials used to form the body 18. The metal bar 56 extends across a portion of the hollow portion 36 of the body 18 and is adjustably connected to the inside surface 38 of the hollow portion 18. A first end region 58 of the metal bar 56 is connected in a region 40 near the first end of the neck 16 using fasteners 60 and a second end 62 of the metal bar 56 terminates in the hollow portion 36 of the body 18 and extends parallel to the longitudinal axis A-A of the neck 16.

Figure 5:
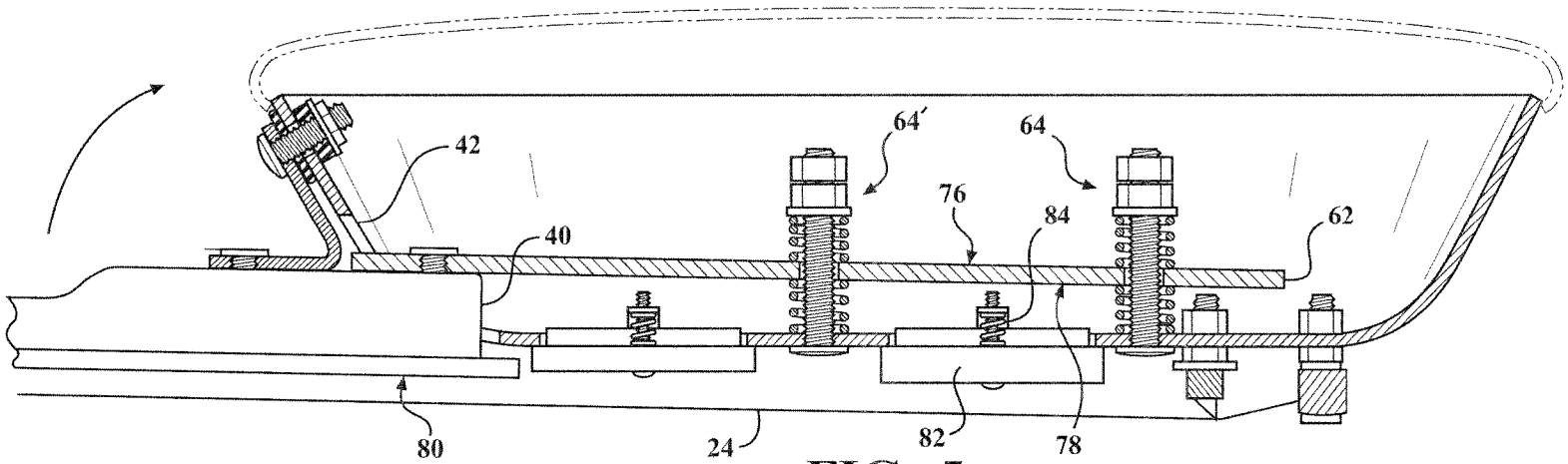
FIG. 5 is a cross-sectional side plan view of a portion of the stringed instrument.

The metal bar 56 is held in place by spring loaded connections 64, 64' between the metal bar 56 and the inside surface 38 of the hollow portion 36. FIGS. 2-5 show two spring loaded connections 64, 64'. However it is within the scope of the invention for there to be a greater or lesser number of spring loaded connections depending on the side of the metal bar 56 and neck 16. Each spring loaded connection 64, 64' includes at least one post 66 connected to the inside surface 38 and the metal bar 56. The post 66 extends through an aperture 68 through the metal bar 56 and in the embodiment shown, the post 66 has threads provided that allow for a retainer, which in the present embodiment of the invention is a nut and washer 70 that connects and holds the metal bar 56 to the post 66. The threads, nut and washer 70 also allow for the metal bar 56 to be adjusted vertically along a longitudinal axis B-B of the post 66, which allows for the neck 16 height to be adjusted. Adjustable neck height is shown in FIG. 5, where there is a height H1 is the distance between a fret surface 80 on the neck 16 and the plurality of strings 24. H2 is a second distance between the fret surface 80 and the plurality of strings 24. H1 has a shorter distance between the fret surface 80 and the plurality of strings 24 than H2, which is caused by adjusting the nut and washer 70 to cause the metal bar 56 to change position the longitudinal axis B-B on the posts 66.

The threads, nut and washer 70 also help to control the tension of a top side compression spring 72 and a bottom side compression spring 74, which are positioned above and below the metal bar 56 so that the metal bar is able to pivot bidirectionally when the neck 16 is pivoted, yet recoil back to the same position when pressure on the neck 16 is removed. The top side compression spring 72 and the bottom side compression spring 74 are connected about the post 66. The top side compression spring 72 extends between a top side 76 of the metal bar 56 and the nut and washer 70, while the bottom side compression spring 74 extends between a bottom surface 78 of the metal bar 56 and the inside surface 38.

Further comprising an amplifier pick up 82 connected to the inside surface 38 of the hollow portion 35 of the body 18 and extending through the body 18 to the outside surface 22 and positioned at a location near the plurality of strings 24. In the hollow portion 35 the amplifier pick up 82 is connected to the inside surface 38 at a location between the inside surface 38 and the metal bar 56. The amplifier pick up 82 is connected to the inside surface 38 using a spring loaded fastener nut 84 that recoil ably holds the amplifier pick up 82 to the inside surface 38. The connection of the amplifier pick up 82 to the inside surface 38 is adjustable with the spring loaded fastener nut 84 in order to allow the amplifier pick up 82 to be moved closer or further away from the plurality of strings 24. This adjustment allows for the amplifier pick up 82 to be adjusted for different applications since the distance between the metal bar 56 and the inside surface 38 can vary depending on the design of the stringed instrument 10, body 18 and neck 16. Additionally the spring loaded fastener nut 84 and amplifier pick up 82 provides another point of adjustment that can be made depending on the setting of the neck 16 height, discussed above.

Figure 8:
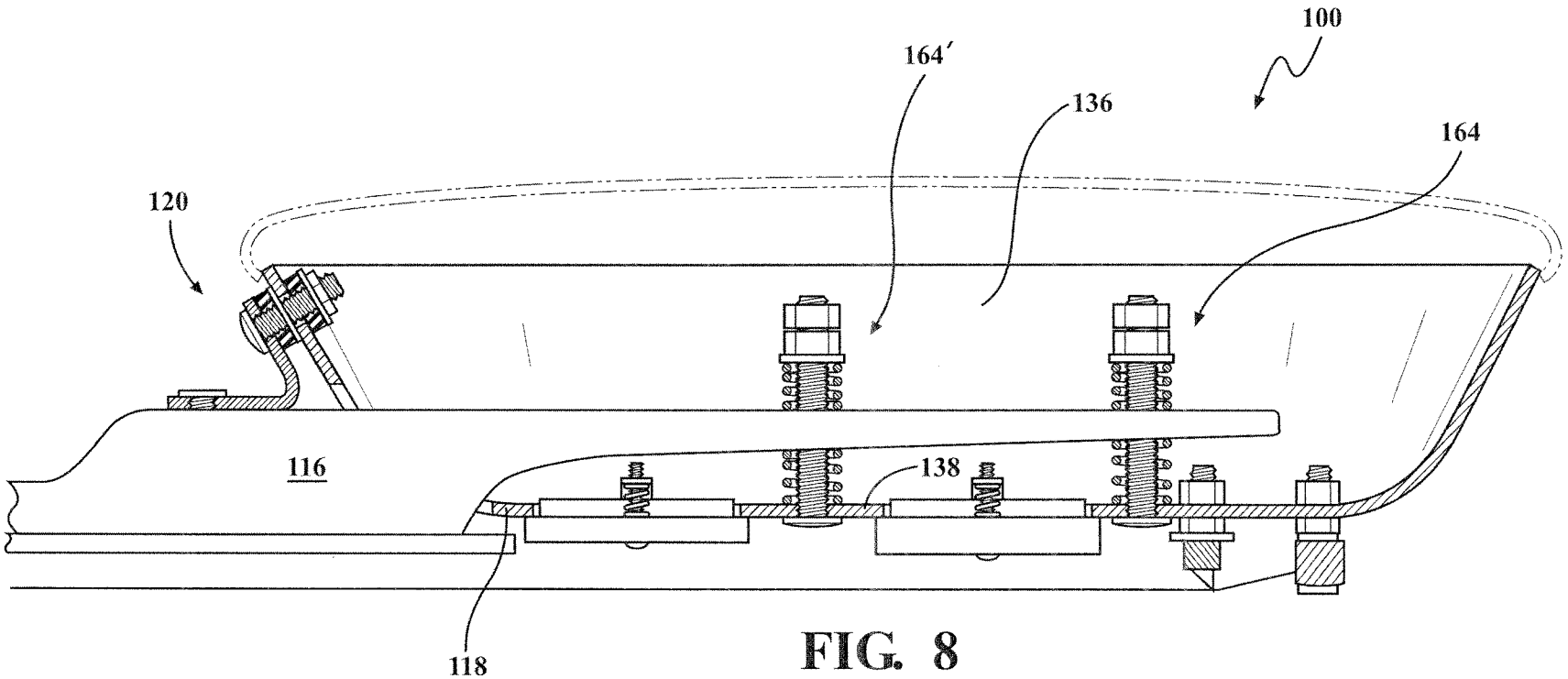
FIG. 8 is a cross-sectional plan view of an alternate embodiment of the invention incorporating the used of an elongated neck.
Figure 9:
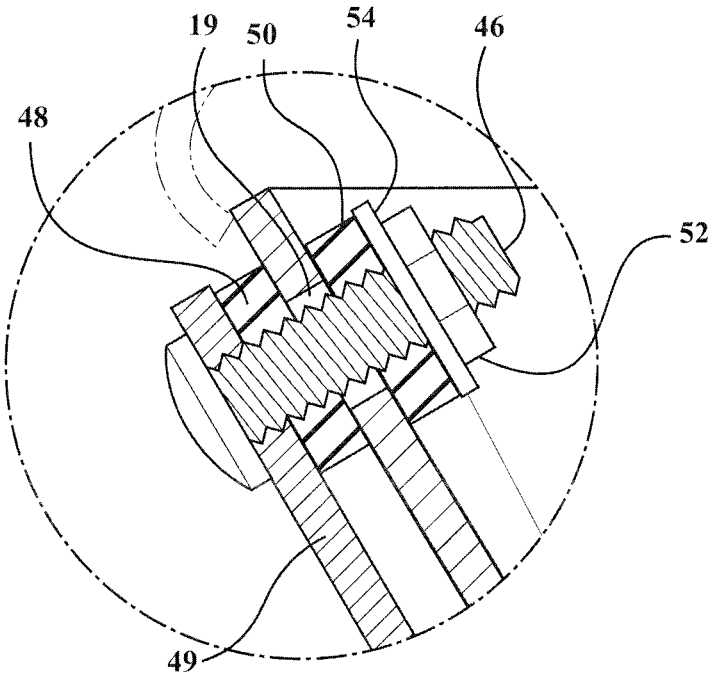
FIG. 9 is a cross sectional side plan view of a portion of the flexible connection bracket connection with the body.

In another aspect of the invention, shown in FIG. 8 there is a stringed instrument 100 depicted in FIG. 8 there is an elongated neck 116 without a separate metal bar 56 show in the other drawings. Instead the thickness of the elongated neck 116 tapers from the point near where the elongated neck 116 enters a body 118 to the first end of the neck to allow for the neck to pivot in a manner similar to the embodiments shown in FIGS. 2-5. The elongated neck 116 is connected to an inside surface 138 of a hollow potion 136 of the body 118 using spring loaded connections 164, 164' that are arranged and operate in a manner similar to the spring loaded connections 64, 64' shown in in FIGS. 2-5. Aldo there is a flexible connection bracket 120 that connects between the elongated neck 116 and the body 118 in a way that allows three hundred sixty degree pivoting of the elongated neck 116, in a manner similar to the flexible connection bracket 20 described above.

Figure 7:
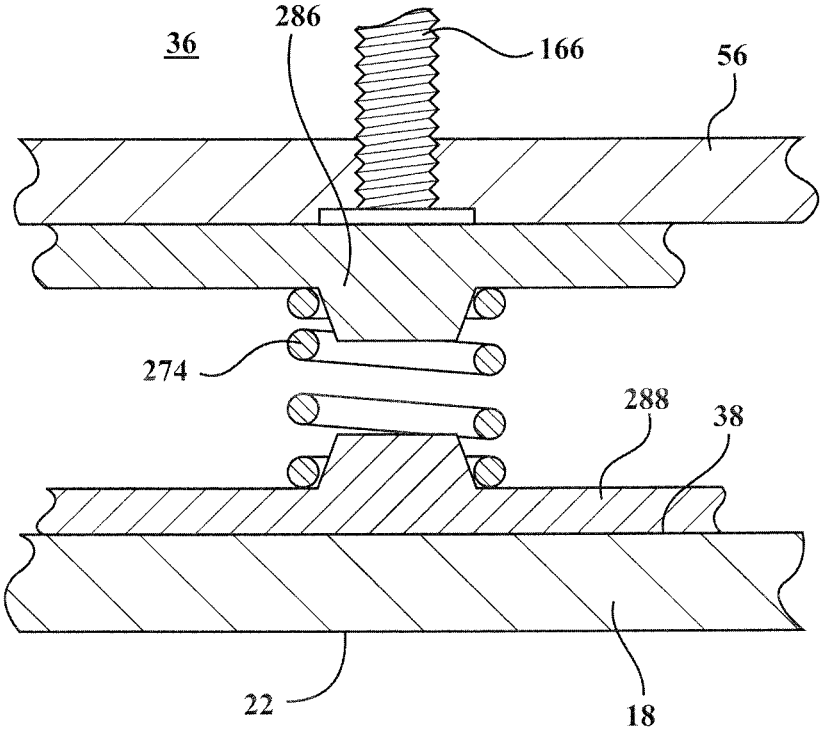
FIG. 7 is a cross-sectional enlarged view of an alternate spring configuration in accordance with the present invention.

Referring now to FIG. 7 an alternate embodiment of bottom side compression spring 74 shown in FIGS. 2-5 is depicted where the post 66 and that the bottom side compression spring 74 is eliminated. Instead a bottom side compression spring 274 is positioned between a first opposing tab 286, connected to the metal bar 56 and a second opposing tab 288 connected to the inside surface 38 of the body 18. There is also a post 166 that connects to the metal bar 52 and extends into the hollow potion 36. This alternate embodiment eliminates having the post 66 extend from the outside surface 22 of the body 18 thereby keeping less visible components from being seen on the outside surface 22.

Figure 6A:
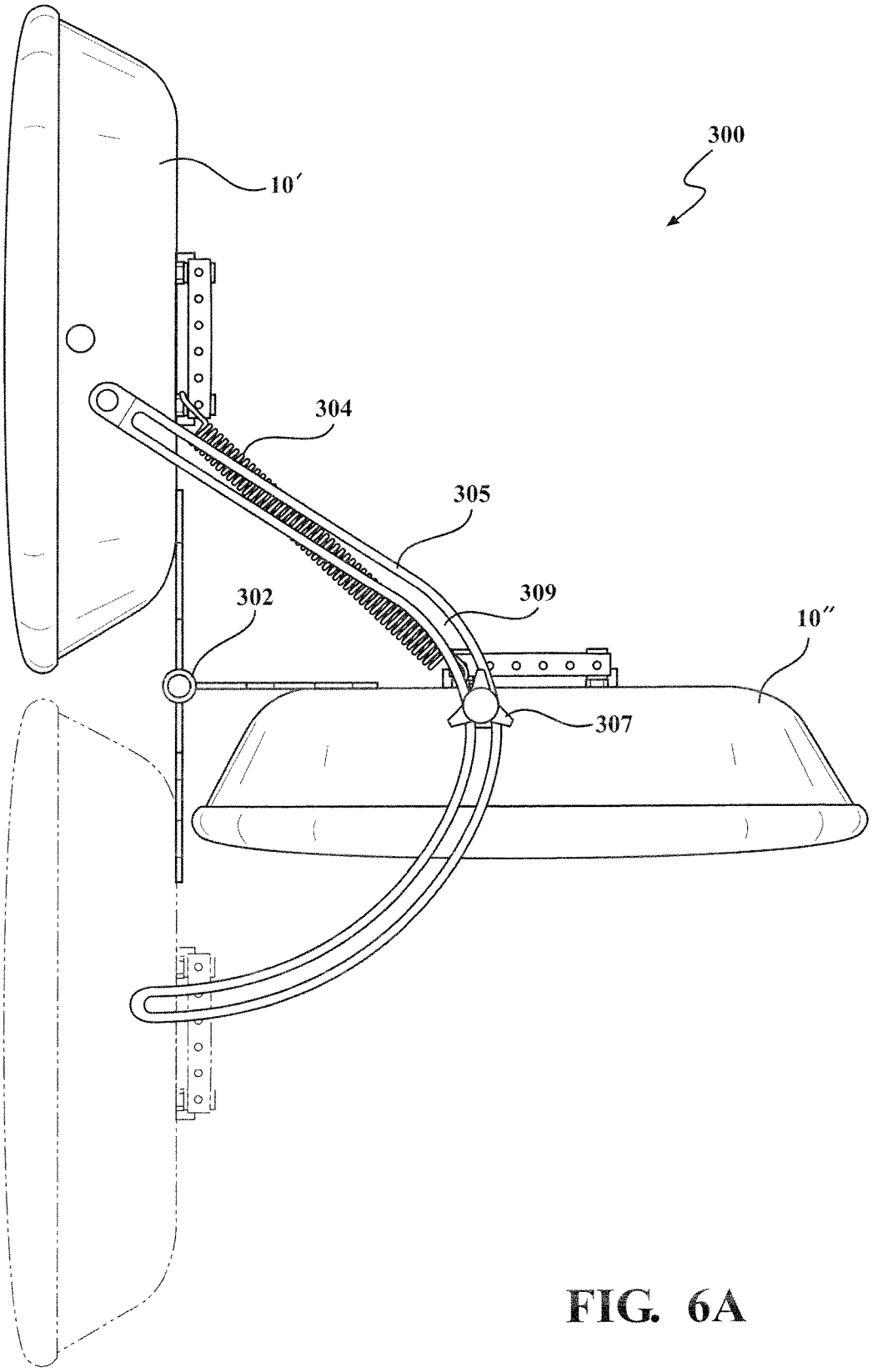
FIG. 6A is a perspective side view of a stringed instrument in accordance with the second embodiment of the invention.
Figure 6B:
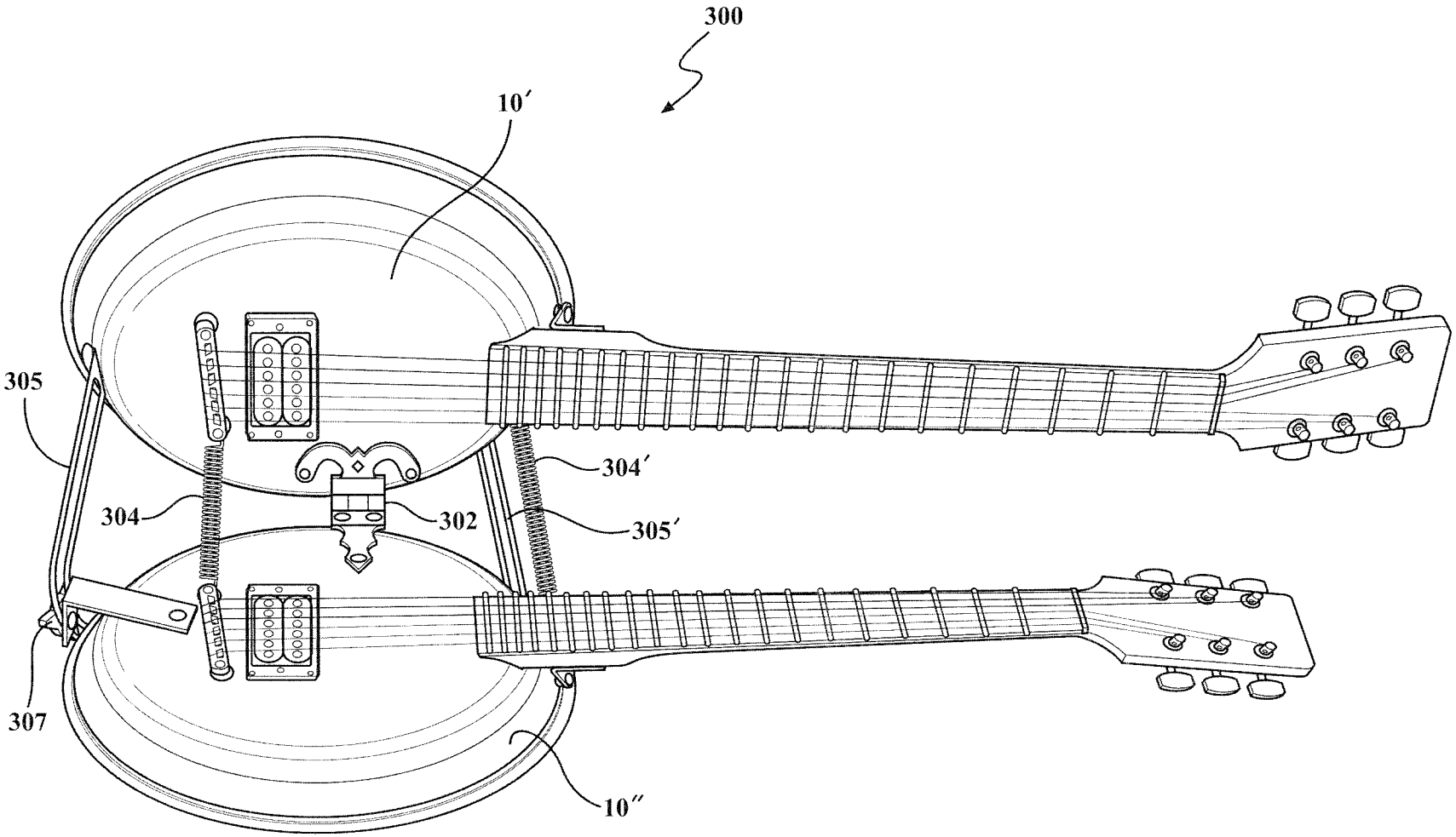
FIG. 6B is an engled front view of a stringed instrument in accordance with a second embodiment of the invention.

Referring now to FIGS. 6A and 6B a stringed instrument combination 300 is shown in accordance with another aspect of the present invention. The stringed instrument combination 300 incorporates two stringed instruments 10', 10" having tremolos similar to the other embodiments of the invention described above. The stringed instrument combination 300 has at least one hinge 302 connecting to the body of each stringed instrument 10', 10" in order to allow the stringed instrument 10" to pivot and connect relative to the stringed instrument 10'. In a first position each stringed instrument 10', 10" are arranged in parallel to each other and are playable in an over under manner. In a second position the stringed instrument 10" is pivoted to an angle that is generally perpendicular to the stringed instrument 10' using the at least one hinge 302.

There is also at least one spring 304, 304' or damper that is connected to each stringed instrument 10', 10" that assists in moving the stringed instrument 10" between the first and second positions. In addition to having two positions shown, it is possible to lock the instrument 10" at many different positions along two adjustable instrument support hinges 305, 305' that each have a slot 307. A tension knob 307 is tightened or loosened to hold the instrument 10" at a desired position. When the stringed instrument 10" is in the second position is can rested and played on a table, or on the lap of the user and plays like an instrument commonly referred to as a lap steel. Also while in the second position the stringed instrument 10' can be played like a guitar. When in the first position both the stringed instruments 10', 10" can be played like a guitar. The stringed instrument combination 300 allows for each stringed instrument to be tuned differently, thereby creating different sounds.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A stringed instrument comprising:

a body having a hollow portion with an inside surface of the hollow potion;

a neck having a first end extending through the body into the hollow portion of the body and a second end extending away from the body, wherein the neck has a longitudinal axis extending between the first end and the second end;

at least one flexible connection between the neck and the body, wherein the at least one flexible connection allows the neck to pivot at one or more angles relative to the longitudinal axis of the neck;

a plurality of strings disposed above at least the body and the neck and having a first end connected to the neck;

a bridge coupled to the body and coupled to a second end of the plurality of strings;

a metal bar extending across a portion of the hollow portion of the body connected to the inside surface of the hollow portion, the metal bar is connected to the first end of the neck near a first end of the metal bar and a second end of the metal bar extends in parallel along the longitudinal axis of the neck; and at least one spring loaded connection between the metal bar and the inside surface of the hollow portion having at least one post connected to the inside surface and the metal bar with a bottom side compression spring connected about the at least one post, the bottom side compression spring extends between a bottom surface of the metal bar and the inside surface of the body such that the metal bar rests on the bottom side compression spring and selectively allows the metal bar to pivot at one or more angles relative to the longitudinal axis of the neck.

2. The stringed instrument of claim 1 wherein the at least one post extends through an aperture formed through the metal bar and at least one spring loaded connection further includes a top side compression spring connected about the post and extending between a top surface of the metal bar and a retainer connected to the post.

3. The stringed instrument of claim 1 wherein the at least one post extends through an aperture formed through the metal bar and the at least one post has adjustment threads and a retainer connected to the at least one post for adjustably holding the metal bar at a height defined by an axis of the at least one post, thereby allowing the height of the metal bar and the neck of the metal bar to be adjusted to increase or decrease the distance of the plurality of strings and the body and the neck of the stringed instrument.

4. The stringed instrument of claim 1, wherein the body of the stringed instrument is formed of steel.

5. The stringed instrument of claim 1 further comprising a leg grip connected to the outside surface of the body.

6. The stringed instrument of claim 5 further comprising a top grip opposite the location of the leg grip allowing a user of the stringed instrument to grasp the top grip with one hand, while holding the body of the stringed instrument with the leg grip by pressing the leg grip onto the leg of the user.

7. The stringed instrument of claim 1 further comprising an amplifier pick up connected to the inside surface of the hollow portion of the body, where in the amplifier pick up is positioned between the metal bar and the inside surface of the housing.

8. The stringed instrument of claim 7 wherein the amplifier pick up further includes a spring loaded fastener nut connecting the amplifier pickup to the inside surface of the body, wherein the spring loaded fastener nut us adjustable to move the amplifier pickup closer or farther away from the plurality of springs.

9. A stringed instrument comprising:

a body having a hollow portion with an inside surface of the hollow potion;

a neck having a first end extending through the body into the hollow portion of the body and a second end extending away from the body, wherein the neck has a longitudinal axis extending between the first end and the second end;

at least one flexible connection between the neck and the body, wherein the at least one flexible connection allows the neck to pivot at one or more angles relative to the longitudinal axis of the neck;

a plurality of strings disposed above at least the body and the neck and having a first end connected to the neck;

a bridge coupled to the body and coupled to a second end of the plurality of strings;

a metal bar extending across a portion of the hollow portion of the body connected to the inside surface of the hollow portion, the metal bar is connected to the first end of the neck near a first end of the metal bar and a second end of the metal bar extends in parallel along the longitudinal axis of the neck; and at least one spring loaded connection between the metal bar and the inside surface of the hollow portion having at least one post connected to the inside surface and the metal bar and extending through an aperture formed through the metal bar, wherein the at least one spring loaded connection includes a bottom side compression spring and a top side compression spring both connected about the at least one post, the bottom side compression spring extends between a bottom surface of the metal bar and the inside surface of the body such that the metal bar rests on the bottom side compression spring and the top side compression spring extend between a top surface of the metal bar and a retainer connected to the at least one post, wherein the top side compression spring and the bottom side compression spring selectively allow the metal bar to pivot at one or more angles relative to the longitudinal axis of the neck.

10. The stringed instrument of claim 9 wherein the at least one post has adjustment threads that lock and move the retainer connected to the at least one post for adjustably holding the metal bar at a height defined by an axis of the at least one post, thereby allowing the height of the metal bar and the neck of the metal bar to be adjusted to increase or decrease the distance of the plurality of strings and the body and the neck of the stringed instrument.

11. The stringed instrument of claim 9, wherein the body of the stringed instrument is formed of steel.

12. The stringed instrument of claim 9 further comprising a leg grip connected to the outside surface of the body.

13. The stringed instrument of claim 12 further comprising a top grip opposite the location of the leg grip allowing a user of the stringed instrument to grasp the top grip with one hand, while holding the body of the stringed instrument with the leg grip by pressing the leg grip onto the leg of the user.

14. The stringed instrument of claim 9 further comprising an amplifier pick up connected to the inside surface of the hollow portion of the body, where in the amplifier pick up is positioned between the metal bar and the inside surface of the housing.

15. The stringed instrument of claim 14 wherein the amplifier pick up further includes a spring loaded fastener nut connecting the amplifier pickup to the inside surface of the body, wherein the spring loaded fastener nut us adjustable to move the amplifier pickup closer or farther away from the plurality of springs.

16. A stringed instrument comprising:

a body having a hollow portion with an inside surface of the hollow potion;

a neck having a first end extending through the body into the hollow portion of the body and a second end extending away from the body, wherein the neck has a longitudinal axis extending between the first end and the second end;

at least one flexible connection between the neck and the body, wherein the at least one flexible connection allows the neck to pivot at one or more angles relative to the longitudinal axis of the neck;

a plurality of strings disposed above at least the body and the neck and having a first end connected to the neck;

a bridge coupled to the body and coupled to a second end of the plurality of strings;

a metal bar extending across a portion of the hollow portion of the body connected to the inside surface of the hollow portion, the metal bar is connected to the first end of the neck near a first end of the metal bar and a second end of the metal bar extends in parallel along the longitudinal axis of the neck; and at least one spring loaded connection between the metal bar and the inside surface of the hollow portion having at least one post connected to the inside surface and the metal bar and extending through an aperture formed through the metal bar, wherein the at least one spring loaded connection includes a bottom side compression spring and a top side compression spring both connected about the at least one post, the bottom side compression spring extends between a bottom surface of the metal bar and the inside surface of the body such that the metal bar rests on the bottom side compression spring and the top side compression spring extend between a top surface of the metal bar and a retainer connected to the at least one post, wherein the top side compression spring and the bottom side compression spring selectively allow the metal bar to pivot at one or more angles relative to the longitudinal axis of the neck, wherein the at least one post has adjustment threads that lock and move the retainer connected to the at least one post for adjustably holding the metal bar at a height defined by an axis of the at least one post, thereby allowing the height of the metal bar and the neck of the metal bar to be adjusted to increase or decrease the distance of the plurality of strings and the body and the neck of the stringed instrument.

17. The stringed instrument of claim 16 further comprising a leg grip connected to the outside surface of the body.

18. The stringed instrument of claim 17 further comprising a top grip opposite the location of the leg grip allowing a user of the stringed instrument to grasp the top grip with one hand, while holding the body of the stringed instrument with the leg grip by pressing the leg grip onto the leg of the user.

19. The stringed instrument of claim 16 further comprising an amplifier pick up connected to the inside surface of the hollow portion of the body, where in the amplifier pick up is positioned between the metal bar and the inside surface of the housing.

20. The stringed instrument of claim 19 wherein the amplifier pick up further includes a spring loaded fastener nut connecting the amplifier pickup to the inside surface of the body, wherein the spring loaded fastener nut us adjustable to move the amplifier pickup closer or farther away from the plurality of springs.

* * * * *